US005753076A

United States Patent [19]

Costello et al.

[11] Patent Number: 5,753,076

[45] Date of Patent: May 19, 1998

[54] METHOD FOR CREPING TISSUE

[75] Inventors: Peter King Costello, Neenah; Clifford Lee Alberts, Appleton, both of Wis.

[73] Assignee: Kimberly-Clark Worldwide, Inc., Neenah, Wis.

[21] Appl. No.: 794,702

[22] Filed: Feb. 3, 1997

[51] Int. Cl.[6] ..... B31F 1/12; B31F 1/14

[52] U.S. Cl. ..... 162/111; 264/282; 162/280

[58] Field of Search ..... 162/111, 280, 162/281; 264/284, 283, 282; 15/256.5, 256.51

[56] References Cited

U.S. PATENT DOCUMENTS

| | | | |
|---|---|---|---|
| 3,728,051 | 4/1973 | Humbert | 418/178 |
| 4,349,934 | 9/1982 | Margittai | 15/256.51 |
| 4,839,245 | 6/1989 | Sue et al. | 428/698 |
| 4,919,877 | 4/1990 | Parsons et al. | 264/282 |
| 4,969,378 | 11/1990 | Lu et al. | 76/108.2 |
| 5,102,606 | 4/1992 | Ake et al. | 264/282 |
| 5,120,596 | 6/1992 | Yamada | 428/216 |
| 5,123,152 | 6/1992 | Tenkula et al. | 29/132 |

OTHER PUBLICATIONS

Weck, M. and K. Schlotermann, "Plasma Nitriding to Enhance Gem Properties," *Industrie–Anzeiger*, Nr. 13 v. 16. 2. 1983/105. Jg, pp. 27–31.

*Primary Examiner*—Donald E. Czaja
*Assistant Examiner*—Jose A. Fortuna

[57] ABSTRACT

Creping doctor blades useful for making soft tissues are substantially improved by ion nitriding the surface(s) of the doctor blade to produce a hardened surface while retaining the resilient interior of the non-treated blade. The resulting blades have approximately a three-fold increase in blade life.

4 Claims, 4 Drawing Sheets

METHOD FOR CREPING TISSUE

BACKGROUND OF THE INVENTION

In the manufacture of creped tissue products such as facial tissue, bath tissue, paper towels and the like, a wet tissue web of papermaking fibers is formed, partially dewatered and transferred to the surface of a rotating, heated drying cylinder known as a Yankee dryer. The web is adhered to the surface of the Yankee dryer with a creping adhesive. The web is then dislodged from the surface of the Yankee dryer by contact with a doctor blade which is positioned to press up against the surface of the Yankee. As the web contacts the doctor blade, the impact partially debonds the sheet, thereby increasing the softness of the resulting product.

A universal problem with such a process is that the doctor blades wear and must continually be replaced. Changing the blades not only reduces the efficiency of the manufacturing operation, but also impacts the quality of the tissue produced because the blade geometry changes as it wears. Normally the worn blades are reground and used again. The frequency of blade changes is dependent upon the particular tissue making process, but it is typical for high speed tissue machines to have blade changes every 1 to 4 hours.

Therefore there is a need for an improved doctor blade to improve the efficiency of making creped tissue.

SUMMARY OF THE INVENTION

It has now been discovered that the creping process can be improved by using a doctor blade that has been ion nitrided. Applicants have found that ion nitriding not only increases the hardness of the doctor blade, but also retains the ductility of the core of the blade, which is also necessary for blade life. Merely hardening the blades by conventional means would leave them brittle and prone to breaking under the flexural stresses to which the blades are subjected when loaded against the surface of the Yankee. It has been found that ion nitrided blades last at least about three times longer between grindings than conventional steel blades. Furthermore, depending upon the execution, the ion nitrided blades can be reground and reused without an additional ion nitriding treatment. This provides an additional cost savings.

Hence in one aspect, the invention resides in a method for creping tissue sheets comprising: (a) adhering a tissue sheet to the surface of a rotating creping cylinder; and (b) dislodging the tissue sheet from the surface of the creping cylinder by contacting a doctor blade having a non-brittle interior with sufficient resiliency to bend under normal creping loads without breaking and a surface hardness of about 55 Rockwell C or greater.

In another aspect, the invention resides in a creping doctor blade having a nonbrittle interior with sufficient resiliency to bend under normal creping loads without breaking, said doctor blade having a bottom surface (surface that contacts the dryer), an operating face surface (surface which contacts the tissue) and a top surface (flat surface of blade away from dryer), wherein at least the bottom surface has a surface hardness of about 55 Rockwell C hardness or greater.

In another aspect, the invention resides in an ion nitrided doctor blade useful for creping tissue.

The hardness of the various surfaces of the creping doctor blades of this invention can be about 55 Rockwell C or greater, more specifically about 60 Rockwell C or greater, still more specifically about 65 Rockwell C or greater, and still more specifically from about 55 to about 65 Rockwell C. A preferred means for hardening the creping doctor blade surfaces is ion nitriding.

As used herein, "ion nitriding" is a method to surface harden materials made of steel or cast iron with nitrogen. More specifically, a work piece, such as a doctor blade, is placed in a vacuum chamber, electrically isolated from the vessel, and the air is pulled out creating a vacuum. In this vacuum, a charge is put on the parts, making them cathodic (negative charge) and the vessel wall anodic (positive charge). A mixture of nitrogen ($N_2$) and hydrogen ($H_2$) is bled slowly into the chamber. The electrical charge ionizes the nitrogen molecules into positively charged nitrogen ions, thus freeing the associated electrons. The electrons are attracted to the positively charged vessel wall, and the nitrogen ions fly at the speed of light into the surface of the negatively charged part. This bombardment both heats the part and pulls atoms and ions of the metal into the gas, where nitrides are formed with the nitrogen ions present. These nitrides then redeposit on the surface of the part, creating a hard layer within the steel. The temperature of this process is controlled independently through the pressure of the gas and the voltage and current from the power supply. Temperatures vary from 850° to 1100° F.

The surface of the treated work piece essentially consists of a very thin outer layer of an intermetallic compound of iron and nitrogen, commonly referred to as the white layer. The white layer compound can be of several forms, including an intermetallic compound in the form of $Fe_4N$ with a face centered cubic structure or $Fe_{2-3}N$ with a hexagonal lattice structure. The thickness of the white layer can be from about 0.00005 to about 0.0006 inch. Below the white layer is a thicker layer, referred to as the diffusion zone, in which the nitrogen is in solution with the existing iron in the work piece. The thickness of the diffusion zone can be from about 0.001 to about 0.01 inch. Among other things, the specific properties of the ion nitrided surface will depend on the nitriding conditions and the composition of the work piece.

The ion nitriding process is further described in "Plasma Nitriding to Enhance Gem Properties", W. Weck e.k. Schlotermann, Industrie-Anzieger, Vol. 13 (1983), pp. 27–31, which is herein incorporated by reference.

DETAILED DESCRIPTION OF THE DRAWING

Figure 1:
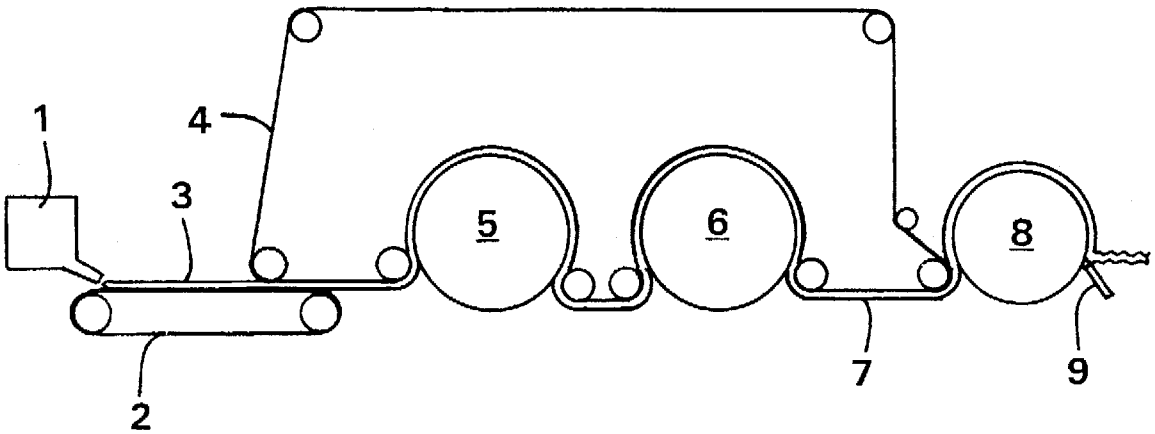
FIG. 1 is a schematic illustration of a tissue making process, illustrating how creping fits into the overall process.

Referring to FIG. 1, shown is a schematic process diagram of a throughdrying tissue making process in which the creping process of this invention is useful. It will be appreciated, however, that many other tissue making processes, such as wet-pressing processes, can also be used. Shown is a headbox 1 from which an aqueous suspension of papermaking fibers is deposited onto a forming fabric 2 to form a wet web 3. The wet web is transferred to a throughdrying fabric 4 and passed over a throughdryer 5 and optionally over a second throughdryer 6, during which time hot air is blown through the wet web to dry it. The dried web 7 is transferred to the surface of a creping cylinder 8, such as a Yankee dryer, and creped using a creping doctor blade 9 to yield a soft tissue sheet.

Figure 2:
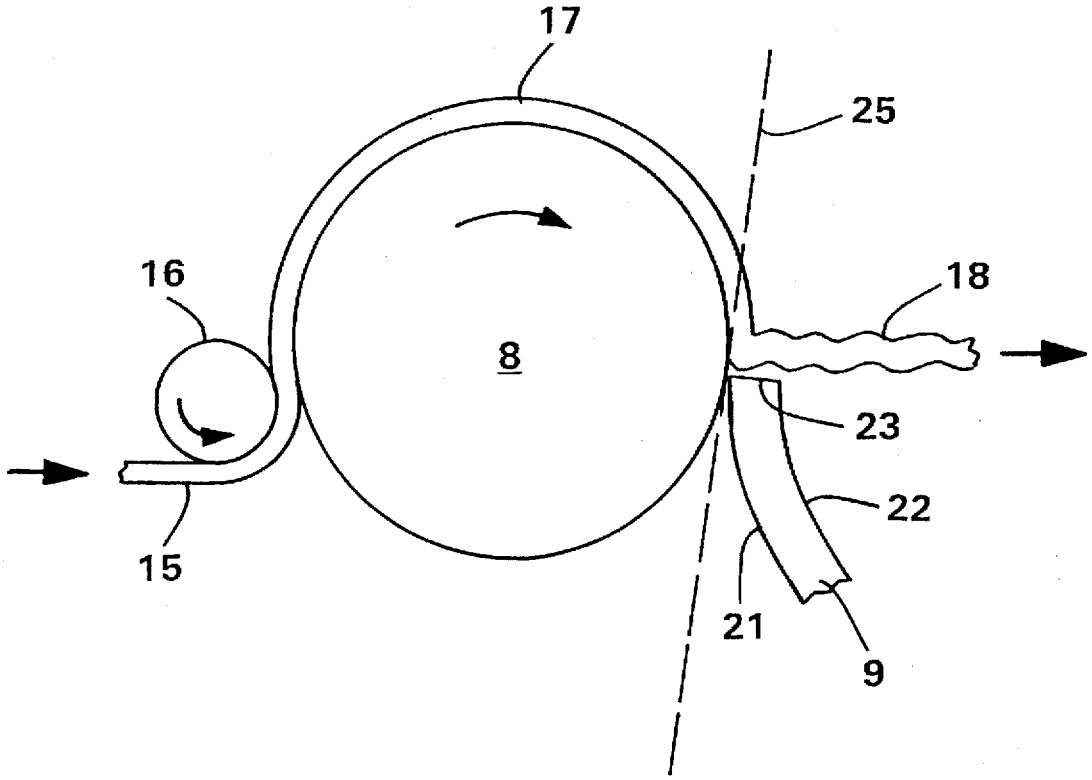
FIG. 2 is a schematic illustration of the creping process, more specifically illustrating the relationship between the creping doctor blade and the surface of the creping cylinder.

FIG. 2 is a schematic illustration of the creping process, more specifically illustrating the operation of the creping doctor blade 9. Shown is the tissue sheet or web 15 being pressed and adhered to the surface of the creping cylinder 8 using pressure roll 16. The adhered web 17 is dislodged from the surface of the creping cylinder by contact with the creping doctor blade 9, resulting in a creped tissue sheet 18. The creping doctor blade 9 is loaded against the surface of the creping cylinder under a pressure of about 50 pounds per lineal inch of blade. This loading pressure causes the blade to flex as schematically illustrated. As used herein, the doctor blade has three surfaces shown. They are the bottom surface 21, the top surface 22 and the operating face 23. The operating face directly impacts the web during creping while the bottom surface at the tip of the blade rides on the surface of the creping cylinder. It has been found that the hardness of the bottom surface has a greater influence on blade wear than the hardness of the operating face. The tangent to the surface of the creping cylinder at the point of contact with the doctor blade is illustrated by reference numeral 25.

Figure 3:
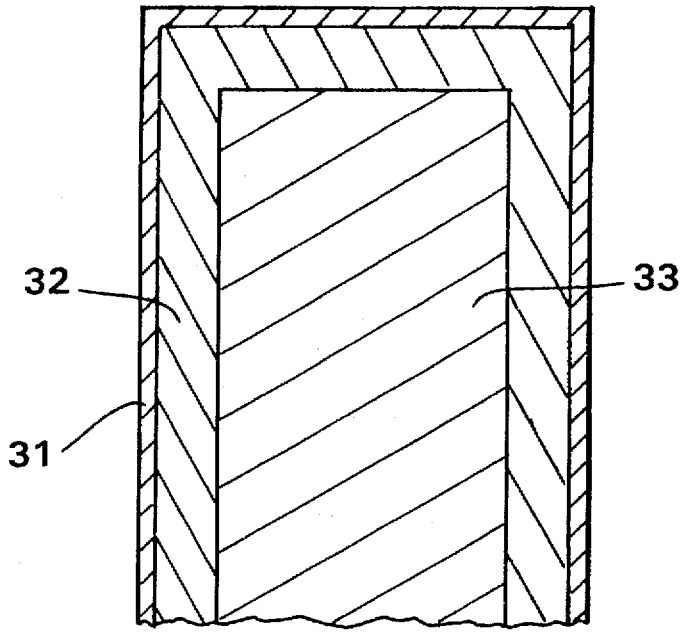
FIG. 3 is a schematic cross-sectional view of the end of a creping doctor blade which has been ion nitrided prior to grinding, illustrating the compound layer and the diffusion layer created by the nitriding treatment.

FIG. 3 is a sectional view of a nitrided creping doctor blade, prior to grinding, illustrating the white layer and the diffusion layer within the blade resulting from the nitriding treatment. The relative thicknesses of the blade and the layers is not to scale. Shown is the white layer 31, the diffusion layer 32 and the base material 33 of the steel creping doctor blade.

Figure 4:
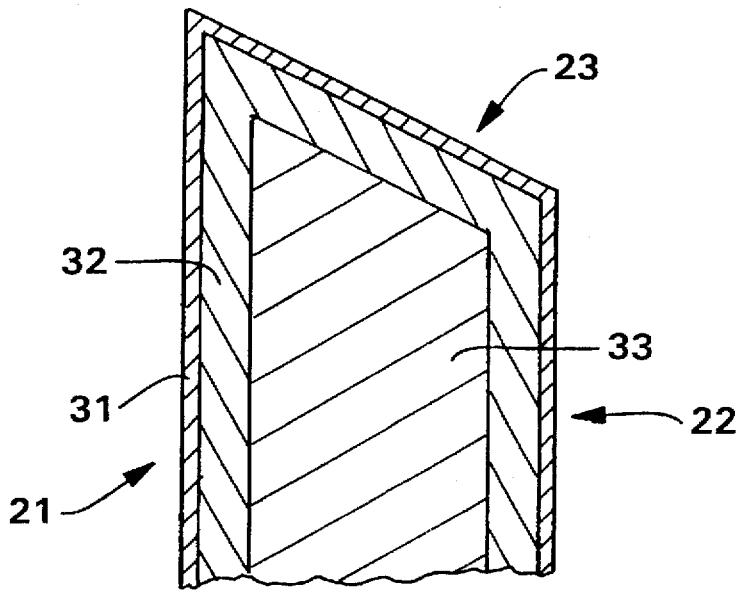
FIG. 4 is a schematic cross-sectional view of a creping doctor blade which has been ground prior to nitriding.

FIG. 4 is a sectional view similar to that of FIG. 3, except the operating face 23 of the creping doctor blade has been ground prior to ion nitriding so that the operating face has a white layer 31. As a result, the top surface, bottom surface and operating face of the doctor blade have the same hardness.

Figure 5:
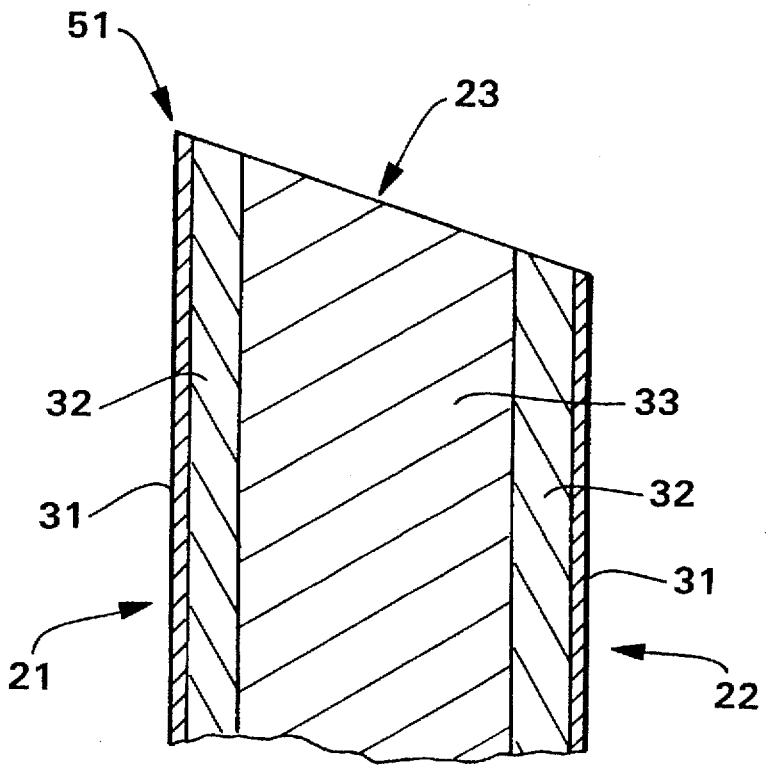
FIG. 5 is a schematic cross-sectional view of a creping doctor blade which has been ground or reground after nitriding.

FIG. 5 is a sectional view similar to that of FIG. 4, except the creping doctor blade has been ground after the ion nitriding treatment, resulting in an operating face which is not ion nitrided. This blade is essentially the result of grinding the blade of FIG. 3 to produce a ground operating face 23. As is apparent from FIG. 5, the blade can be reground several times without changing the presentation to the web. When the tip 51 wears to the point of being operationally unacceptable, the blade is reground and put back into service. In this embodiment, the operating face of the blade has a surface hardness which is less than the hardness of the bottom surface of the blade and is the same as the hardness of the interior of the blade. The hardness of the top and bottom surfaces is essentially the same.

EXAMPLES

Example 1. (Prior Art)

Throughdried bath tissue was made generally in accordance with the process illustrated in FIG. 1. The tissue had a dry basis weight of about 16 pounds per 2880 square feet. The machine speed was about 4500 feet per minute. The substantially dried tissue sheet was adhered to the surface of the Yankee dryer with a creping adhesive and dislodged (creped) with a creping doctor blade. The doctor blade material was AISI 1095 spring steel, quenched and tempered to 46–48 Rockwell C Hardness. The doctor blade was 212 inches long, 4.13 inches wide and 0.025 inch thick. The angle of the operating face of the doctor blade relative to the tangent to the surface of the Yankee at the point of contact between the doctor blade and the surface of the Yankee was about 80°. The angle of the bottom surface of the blade relative to the Yankee surface tangent was about 20°. In order to maintain proper quality, the doctor blade had to be changed every two soft rolls (about 90 minutes of continuous operation).

Example 2. (This Invention)

Throughdried bath tissue was made as described in Example 1, except the doctor blades described in Example 1 were ion nitrided in accordance with this invention. More specifically, the new doctor blade was placed in a vacuum chamber. The blade was electrically isolated from the vessel wall. After removing air from the vessel, nitrogen gas was bled into the vessel under low pressure. The electrical charge placed in the blades made them cathodic relative to the anoidically charged vessel wall. The electrical charge ionized the nitrogen gas molecules into positively charged nitrogen ions strongly attracted to the negatively charged blade surface. This bombardment heated the blade to an average temperature of 860° F. The treatment time was 15 hours. The resulting blade had a gamma prime white layer (compound zone) of 0.0001 inch and a diffusion zone of about 0.005 inch. The hardness of the compound zone was about 65 Rockwell C Hardness. The hardness of the diffusion zone decreased from about 53 Rockwell C Hardness at the boundary with the white layer to about 48 Rockwell C Hardness at the inner boundary toward the center of the blade. The doctor blade was ground to the appropriate blade angle (about 80°), resulting in a blade schematically illustrated in FIG. 5. As with the blades of Example 1, the ion nitrided blades had a non-brittle interior and retained sufficient resiliency to bend under normal creping loads without breaking.

Maintaining the same tissue quality standards used in connection with Example 1, the blades of this invention had to be changed every 7 soft rolls (about 300 minutes of continuous operation), illustrating the substantial increase in blade life with the ion nitrided blades.

It will be appreciated that the foregoing examples, given for purposes of illustration, are not to be construed as limiting the scope of this invention, which is defined by the following claims and all equivalents thereto.

We claim:

1. A method for creping tissue sheets comprising: (a) adhering a tissue sheet to the surface of a rotating creping cylinder; and (b) dislodging the tissue sheet from the surface of the creping cylinder by contacting said surface with a doctor blade which has been ion nitrided, said doctor blade having a non-brittle interior with sufficient resiliency to bend under normal creping loads without breaking and a surface hardness of about 55 Rockwell C or greater.

2. The method of claim 1 wherein the surface hardness of the doctor blade is about 60 Rockwell C or greater.

3. The method of claim 1 wherein the surface hardness of the doctor blade is about 65 Rockwell C or greater.

4. The method of claim 1 wherein the surface hardness of the doctor blade is from about 55 to about 65 Rockwell C.

* * * * *